United States Patent [19]

Sugimoto et al.

[11] Patent Number: 5,025,600

[45] Date of Patent: Jun. 25, 1991

[54] ISOLATION FLOOR SYSTEM FOR EARTHQUAKE

[75] Inventors: Hajime Sugimoto; Yasuo Seko, both of Tokyo, Japan

[73] Assignee: Kaihatsu Architects & Engineers, Inc., Tokyo, Japan

[21] Appl. No.: 369,416

[22] Filed: Jun. 21, 1989

[30] Foreign Application Priority Data

Jun. 24, 1988 [JP] Japan ..... 63-156135

[51] Int. Cl.[5] ..... E04B 1/98

[52] U.S. Cl. ..... 52/167R; 52/573; 248/588

[58] Field of Search ..... 52/167, 573; 248/638, 248/588, 678, 662; 177/134

[56] References Cited

U.S. PATENT DOCUMENTS

| | | | |
|---|---|---|---|
| 2,605,066 | 7/1952 | Brown | 248/678 |
| 4,420,134 | 12/1983 | Flannelly | 248/638 |
| 4,577,826 | 3/1986 | Bergstrom et al. | 248/638 |
| 4,596,373 | 6/1986 | Omi et al. | 248/588 |

FOREIGN PATENT DOCUMENTS

| | | | |
|---|---|---|---|
| 2112596 | 9/1972 | Fed. Rep. of Germany | 177/134 |

*Primary Examiner*—James L. Ridgill, Jr.
*Attorney, Agent, or Firm*—Schwartz & Weinrieb

[57] ABSTRACT

An isolaton floor system for accommodating the effects of an earthquake generally comprises a supporting floor and an isolation floor supported upon the supporting floor so as to be movable in at least one of the vertical and horizontal directions. A damper is interposed between the supporting floor and the isolation floor along the moving direction of the isolation floor. The relative displacement between both of the floors is adjusted by means of a lever or a pulley means to which springs are connected and which is operatively connected to the damper. A relative displacement direction changing mechanism may be further incorporated within the isolation floor system. A laminated rubber member provided with a predetermined shearing resistance is utilized for the damper. Any vibration caused by means of the earthquake is absorbed by means of the damper and the entire structure of the isolation floor system is prevented from being vibrated.

44 Claims, 6 Drawing Sheets

ISOLATION FLOOR SYSTEM FOR EARTHQUAKE

FIELD OF THE INVENTION

This invention relates to an isolation floor system which is effective not only in connection with the accommodation of strong earthquakes, but also weak earthquakes and even ambient micro-vibrations.

BACKGROUND OF THE INVENTION

In the known art, as countermeasures utilized in connection with structures such as, for example, buildings as a means for enabling the structures to withstand earthquakes, there have been considered various designs for the buildings themselves so as to render the structures strong and thereby prevent the buildings from being destroyed or collapsing as a result of the earthquakes, and there have also been considered various designs for the buildings so as to render the structures flexible whereby the same would be capable of absorbing the energy of the earthquake which causes vibration of a building, particularly the floor thereof, with substantially the same amplitude of vibration as that of the earthquake.

In accordance with recent techniques for protecting a building from the effects of an earthquake, a soft and flexible material such as, for example, rubber has been incorporated within the foundation or the basic structure of the building so as to absorb the vibrations caused by the earthquake and to prevent the vibrations from being transmitted to, for example, located upon the base structure of the building, such as, for example, the floor of the building.

Although it may be possible to prevent the building from being destroyed or collapsing by designing current buildings as described above, the known art is not sufficiently effective so as to apply such teachings or technology to existing buildings or structures and, hence, has not adequately provided countermeasures against earthquakes so as to protect equipment such as, for example, precision instruments or office automation systems inclusive of electronic computers from being destroyed, damaged or colliding with each other as a result of such equipment being disposed within existing buildings or structures.

In addition, it is extremely troublesome to reconstruct an existing building so as to provide an isolation floor structure therewithin such that the building would be capable of withstanding the effects of an earthquake and, moreover, such reconstruction work involves considerable much cost.

In order to obviate the problems described above, there has also been proposed an isolation floor system for use within a building structure so as to accommodate the effects of an earthquake to which the oscillations or vibrations due to the earthquake cannot be transmitted when the earthquake occurs, and such isolation floor system is arranged within the building at locations particularly used for supporting computers, containers within which medicines or chemicals are accommodated, or emergency generators.

The known art further provides a countermeasure by means of which a floor upon which the computers, medicine containers or the emergency generators are disposed is partially constructed as an isolation floor structure, such as, for example, disclosed in the Japanese Patent Publication No. 60-59381 or Japanese Patent Laid-open Publication No. 59-47543.

With the isolation floor system of the disclosed type, an isolation floor is constructed so as to be movable in either one of the horizontal or vertical directions or in both of these directions with respect to a floor for supporting the isolation floor, and a damping device or shock absorbing device such as, for example, a spring means is located between the isolation floor and the supporting floor so as to absorb the vibrations caused during the occurence of the earthquake. Concretely, an X-directional damping device is utilized in connection with the isolation floor so as to render the same movable in the X-direction by roller means. A Y-directional damping device is disposed, above the X-directional isolation floor, so as to render the isolation floor movable in the Y-direction normal to the X-direction. A vertical damping device is further disposed, above the Y-directional isolation floor, in connection with an isolation floor which is movable in the vertical or Z direction. Accordingly, a three dimensional isolation floor system is constructed as a single structural entity.

With the isolation floor system of the character described above, however, it is necessary to design the isolation floor system for accommodating an earthquake so that the displacement amount of the entire isolation floor system is sufficiently larger than any predicted oscillation or vibration amount which may be caused by the earthquake in order to prevent the system from colliding with the surrounding equipment or structure such as, for example, the supporting floors. The application of the large displacement can be achieved by elongating the stroke of the damping device, however, such results in the provision of extra large or wasted space below the isolation floor. Moreover, with an existing building, since only a small space exists below the isolation floor to be utilized for the location of the damping device having a large stroke, it is substantially impossible to locate the isolation floor system within the existing building or structure and it is also difficult to reconstruct the floor system so as to serve as an isolation floor system for accommodating the effects of an earthquake.

Generally, the vibration prevention effect with respect to the earthquake can be improved by elongating the natural frequency of the oscillating portion, and the natural frequency is in inverse proportion to $\frac{1}{2}$ the square of the rigidity and in proportion to $\frac{1}{2}$ the square of the mass. Accordingly, in order to further increase the vibration prevention effect, it is advantageous to reduce the rigidity of the damping device such as, for example, the spring constant thereof in comparison with the mass of the oscillating portion. In order to satisfy this requirement, it is necessary to prepare a spring member having a long effective length, which requires a large space to locate the spring means, and more particularly, the spring means located below the vertically movable isolation floor is required to have a long length relative to the diameter of the spring means, which may result in the longitudinal buckling of the spring means.

There has also been proposed a damping means constructed by alternatingly laminating metallic plates and rubber members, such as, for example disclosed in "JAPANESE MECHANICAL INSTITUTE ASSOCIATION PAPERS, Vol. 53, No. 490". This discloses a damping means disposed normally to the vibration direction so as to absorb the vibration of the isolation floor due to the shearing resistance of the rubber members.

With the damping means of the type described above, the shearing resistance is made small as the axial load of the damping means becomes large, and there the earthquake vibration prevention effect is increased when a large load is applied such as in for example the case where the entire building structure is designed to be prevented from vibrating as a result of the earthquake. When the damping means of such character supports a relatively light isolation floor during an earthquake, the damping means is made elongated and, accordingly, buckling may be caused within the damping means. Moreover, according to the conventional isolation floor structure, it is difficult to adequately elongate natural frequencies, so that there is the fear of resonating along with the vibrations caused by means of the earthquake.

OBJECTS OF THE INVENTION

An object of this invention is to substantially eliminate the defects and drawbacks encountered with the conventional technology and to provide an improved isolation floor system for withstanding an earthquake and which more particularly is capable of absorbing the vertical and horizontal movements, and even three dimensional vibrations or oscillations caused by the earthquake so as to prevent equipment or instruments mounted upon the floor of a building or structure from being damaged or destroyed.

Another object of this invention is to provide an improved isolation floor system for withstanding an earthquake and which has a simple and compact structure which is capable of being manufactured with reduced cost.

SUMMARY OF THE INVENTION

These and other objects can be achieved according to this invention, in accordance with one aspect thereof, by providing an isolation floor system for withstanding an earthquake comprising, a supporting floor, an isolation floor supported by means of the supporting floor so as to be movable in at least one of the vertical and horizontal directions, a damper disposed along a moving direction of the isolation floor so as to connect the supporting floor and the isolation floor, and a mechanism connected in series with the damper for adjusting the relative displacement between the supporting floor and the isolation floor.

In accordance with another aspect, the isolation floor system for withstanding an earthquake and as constructed according to this invention further includes a mechanism interposed between the isolation floor and which is the supporting floor and adapted to change the direction of the relative displacement defined between the isolation floor and the supporting floor, and in accordance with this aspect, the damper is connected to the displacement direction changing mechanism so as to connect the supporting floor and the isolation floor.

In accordance with a further aspect of the invention, the isolation floor system for withstanding an earthquake further includes a mechanism for adjusting the relative displacement defined between the isolation floor and the supporting floor such that the same can be increased or decreased, and in accordance with this aspect, the displacement direction changing mechanism and the displacement adjusting mechanism are connected in series with the damper so as to connect the supporting floor and the isolation floor.

In accordance with a still further aspect of this invention, the above described objects can be achieved by providing an isolation floor system for withstanding an earthquake comprising a supporting floor, an isolation floor supported by means of the supporting floor so as to be movable in at least one of the vertical and horizontal directions, and a damper comprising by a mechnism having a shearing resistance which is variable in response to an axial load or pressure and an axial pressure or load transmitting mechanism provided for the aforementioned mechanism.

According to the construction of the isolation floor system for withstanding an earthquake according to this invention, the damper interposed between the supporting floor and the isolation floor is provided with a displacement amount changing mechanism so as to optionally set the spring constant required, thus making the system itself quite compact. The system further includes the displacement direction changing mechanism so as to immediately perform a countermeasure with respect to a vertical vibration in the case where a load applied to the isolation floor is changed. The damper can be horizontally arranged within a space defined between the supporting floor and the isolation floor, upon a wall of the supporting floor, or within another space, thus efficiently utilizing the available space. The operating direction of the damper can be optionally set. In accordance with another aspect, the damper is constructed by incorporating therein a mechnism for changing the axial load so as to compensate for any change of the shearing resistance due to the axial load so as to provide the isolation floor with a low degree of rigidity whereby the same is capable of effectively absorbing the vibrations regardless of the load to be applied. The mechanism may be composed of a rubber- metallic plate laminated structure in accordance with a preferred embodiment.

BRIEF DESCRIPTION OF THE DRAWING

The preferred embodiments constructed according to this invention will be described hereinafter in further detail with reference to the accompanying drawings in which like reference characters designate like or corresponding parts throughout the several views, and wherein.

DESCRIPTION OF THE PREFERRED EMBODIMENTS

Figure 1:
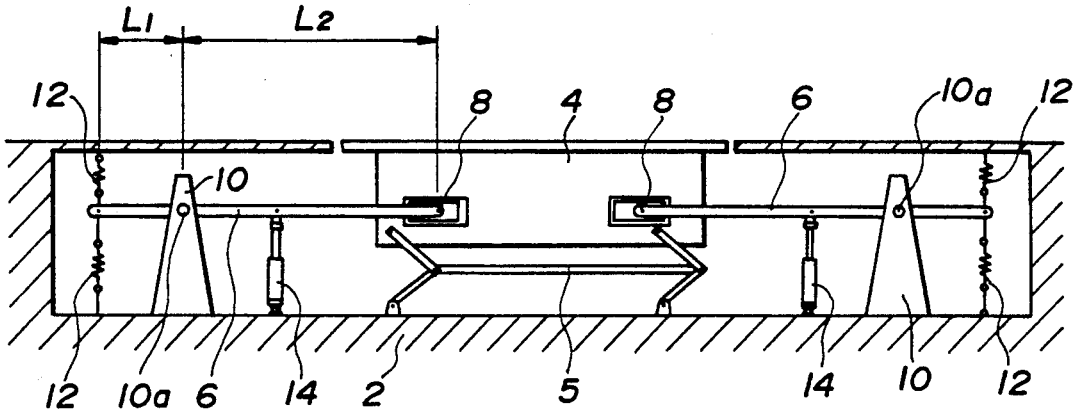
FIG. 1 is a longitudinal section of an isolation floor system constructed according to one embodiment of this invention.

FIG. 1 represents one example of an isolation floor system constructed according to this invention for preventing the transfer of vertical vibrations of an earthquake to a primary building structure. Referring to FIG. 1, a supporting floor 2, which is a floor of an existing structure itself or a floor disposed upon the existing structure, is provided with a recess within which an isolation floor 4 for, withstanding the effects of an earthquake is mounted so as to be vertically movable through means of a linkage mechanism 5 which is movably disposed parallel thereto. A pair of operating rods 6 are secured to both end portions of the insolation floor 4 through means of slide portions 8 which are movable in an axial direction. The operating rods 6 are supported at intermediate portions thereof by means of supporting columns 10 so as to be pivotable about fulcrums 10*a* and two springs 12 are attached at one end thereof to a respective end of the operating rods 6 and at the other end thereof to the supporting floor 2. Hydraulic dampers 14 operated by means of oil are mounted upon the supporting floor 2 so as to be operatively connected to the isolation floor 4 through means of the operating rods 6. The distance defined between the spring end of the operating rod 6 and the fulcrum 10*a* is predetermined so as to be shorter than the distance defined between the fulcrum 10*a* and the slide portion 8.

According to the structure of the isolation floor system shown in FIG. 1, the displacement of the springs 12 can be made smaller than that of the isolation floor 4, so that it becomes possible to utilize springs each having a relatively short length with respect to a conventional system and a compact hydraulic damper having a short stroke. The springs 12 and the hydraulic dampers 14 can be secured to other portions of the operating rods 6 in accordance with the strengths of the springs 12 and the dampers 14. The springs 12 may be predeterminedly endowed with tension in the normally attached condition and, in such case, the supporting floor 2 can be maintained so as not to be affected by means of vibrations having a magnitude below a predetermined value.

Figure 2:
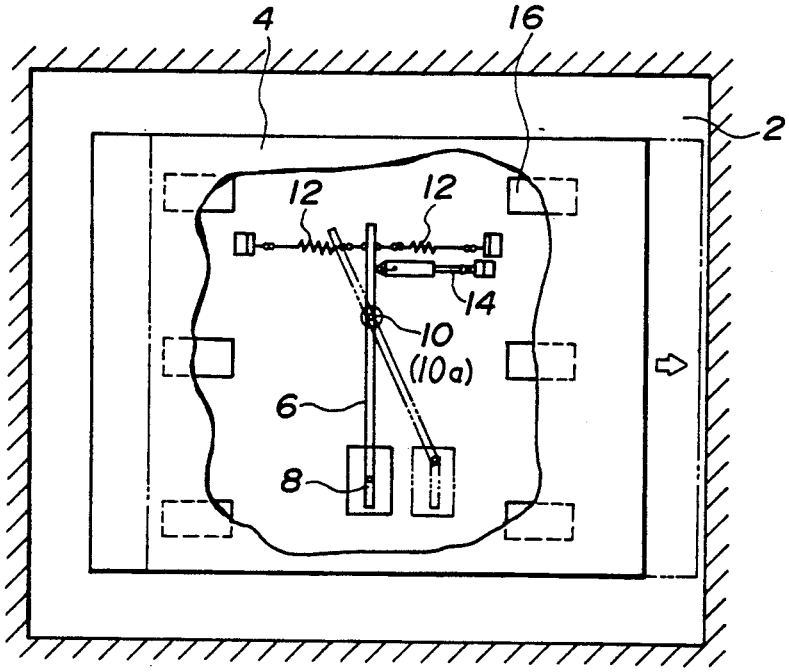
FIGS. 2 and 3 are plan views showing other embodiments according to this invention.

FIG. 2 is a plan view representing an isolation floor system for withstanding the effects of an earthquake which is movable in the horizontal direction, and in which an isolation floor 4 is supported upon the bottom surface portion of the recess formed within a supporting floor 2 by means of bearings 16 so as to be horizontally movable with respect to floor 2. A horizontally disposed operating rod 6 is located beneath surface the isolation floor 4 and is supported by means of a supporting column 10 so as to be pivotable about the fulcrum 10*a*. The operating rod 6 has one end portion connected to the lower surface of the isolation floor 4 through means of a slide portion 8 while the other end portion has springs 12 and a hydraulic damper 14 connected thereto. Each of the springs 12 has one end connected to the operating rod 6 while the other end is stationarily connected to the supporting floor 2. The hydraulic damper 14 also has one end thereof connected to the operating rod 6 and the other end stationarily connected to the supporting floor 2. In this arrangement, the distance between the fulcrum 10*a* and the springs 12 and the damper 14 is less than the distance defined between the fulcrum 10*a* and the slide portion 8 so as to render the strokes of the springs 12 and the damper 14 relatively short thus making these members quite compact.

Figure 3:
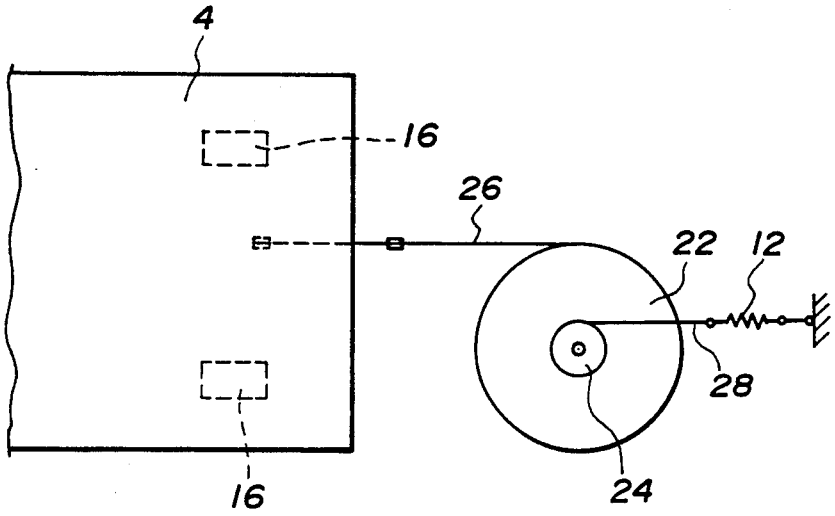

Referring to FIG. 3 representing a further embodiment of this invention, bearings 16 are disposed upon the lower surface of the isolation floor 4 so that the isolation floor 4 is movable in the horizontal direction over the surface of the supporting floor 2 through means of the bearings 16. A wire 26 is secured to an end portion of the isolation floor 4 while the other end of the wire 26 is disposed around a pulley 22 to which another pulley 24 having a diameter smaller than that of the pulley 22 is coaxially mounted, both pulleys being rotatably attached to a shaft, not shown, which is secured to the supporting floor 2. A wire 28 having one end thereof connected to the supporting floor 2 through means of spring 12 is stretched disposed around the pulley 24. Two pulleys 22 of the character described above are symmetrically connected to the isolation floor 4, whereby any vibration caused by means of an earthquake can be damped by means of the springs 12. It is noted that, the diameters of the pulleys 22 and 24 are different from each other accordingly the amount of expansion of the spring 12 is variable in accordance with the relative values of the pulley diameters, so that the springs 12 can be rendered compact in accordance with this embodiment. The springs 12 may be substituted for the hydraulic dampers 14.

Figure 4:
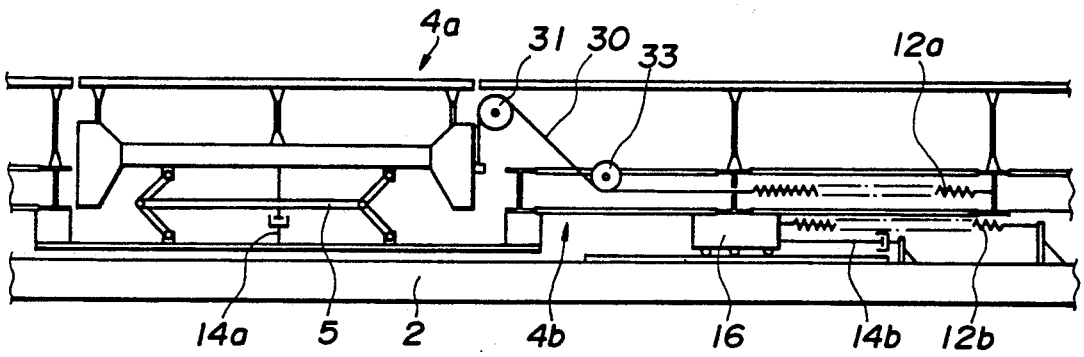
FIGS. 4 and 5 are longitudinal sections of further embodiments according to this invention.

FIG. 4 represents an isolation floor system comprising a further embodiment constructed in accordance with this invention which is movable in mutually orthogonal directions, that is, both vertical, and horizontal directions. In this embodiment, an isolation floor 4*a* is disposed above a link mechanism 5 so as to be vertically movable with respect to another isolation floor 4*b*. The link mechanism 5 comprises a horizontally movable link member, and a hydraulic damper 14*a* operated by means of oil is disposed perpendicular thereto. The isolation floor 4*a* is provided with one end portion to which one end of a wire 30 is connected and the other end of the wire 30 is connected to a spring 12*a* through means of pulley blocks 31 and 33 which effectively interconnect isolation floor 4*a* with provided for the isolation floor 4*b*. The spring 12*a* is horizontally disposed within a space formed within the isolation floor 4*b* and one end of the spring 12*a* is stationarily connected to a beam of the isolation floor 4*b*. A bearing 16 is mounted upon the lower surface of the isolation floor 4*b* so that the isolation floor 4*b* is horizontally movable upon the surface of the supporting floor 2 through means of the bearing 16. To the bearing 16 there is secured a spring 12*b* and a hydraulic damper 14*b*, both having stationary end portions secured to the supporting floor 2, in bilateral and vertical directions with respect to the surface of the drawing paper.

With this embodiment, the vertical movement of the isolation floor 4*a* is converted into horizontal movement by means of the wire 30, so that the spring 12*a* having a sufficient length can be disposed within the space of the isolation floor 4*b* and, moreover, this space is itself formed as a dead space, so that the space is effectively utilized for the location of the spring 12*a* and extra space for the location of this spring 12*a* is not required.

Figure 5:
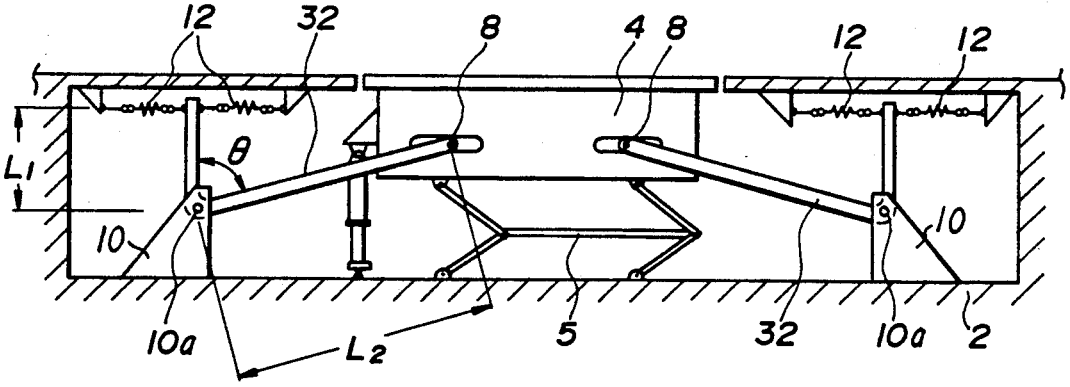

The conversion of the moving direction of the isolation floor 4*a* may be achieved by means of another system other than the described arrangement of FIG. 4 and a modification may be utilized as shown in FIG. 5, in which a lever means is utilized for the conversion of the directional movement. Referring to FIG. 5, the isolation floor 4 is disposed so as to be vertically movable by means of the link mechanism 5, and levers 32 are connected opposite ends or sides of the isolation floor 4. Each of the levers 32 is bent with included angles of $\phi$ and supported at the bent portion by means of a fulcrum 10*a* of a supporting column 10 mounted upon the supporting floor 2 so as to be pivotable about the fulcrum 10*a*. One end of the lever 32 is operatively connected to the isolation floor 4 through means of a slide portion 8 located therewithin and the other end of the lever 32 is connected to springs 12, which extend horizontally upon both sides of the lever 32 so as to expand in the horizontal direction when the lever 32 is pivoted in response to the vertical movement of the isolation floor 4. According to this construction, the springs 12 can be horizontally arranged, whereby the space of the isolation floor system can be effectively utilized. Moreover, the springs 12 can be made compact by changing the lengths L1 and L2 of the lever 32 as defined between the end portions thereof and the fulcrum 10*a* and hence the displacement of the springs 12 can be made smaller than the displacement of the isolation floor 4.

Figure 6:
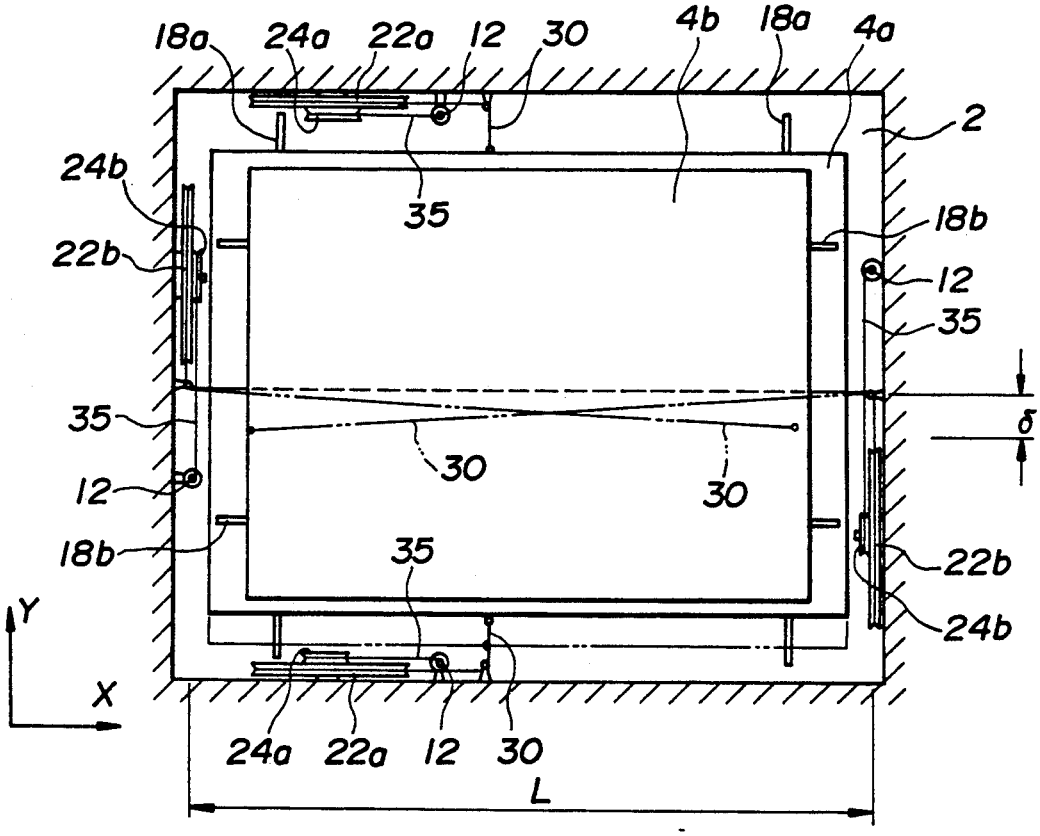
FIGS. 6 and 7 are plan and sectional views, respectively, representing a still further embodiment according to this invention.
Figure 7:
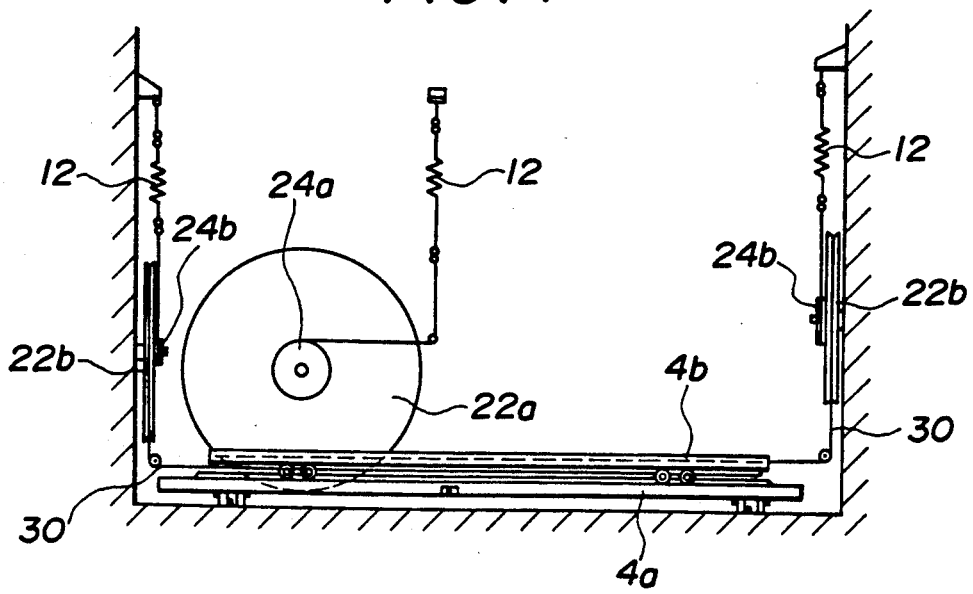

FIGS. 6 and 7 represent an embodiment utilizing a pulley means, in which an isolation floor 4*a* is supported upon rails 18*a* laid upon the surface of a supporting floor 2 so as to movably extend in a Y-direction by pulley means. The isolation floor 4*a* is provided at opposite sides thereof as viewed in the Y-direction wires 30 thereof, with which are connected thereto and wherein the wires 30 further extend and are connected to a pulley 22*a*. A small pulley 24*a* is coaxially mounted upon each pulley 22*a* and the pulley 22*a* together with the pulley 24*a* is rotatably mounted upon the respective walls of the supporting floor 2, which are separated along the Y-direction thereof, with the axes being horizontal. The wires 35 stretched around the pulleys 24*a* are connected to the supporting floor 2 through means of the springs 12. Rails 18*b* are also laid upon the upper surface of the isolation floor 4*a* so as to extend in the X-direction. Upon the rails 18*b* there is support an isolation floor 4*b*, having a structure substantially identical to that of the isolation floor 4*a*, which is movable by pulley means. Pulleys 22*b* are secured to oppositely disposed side walls of the supporting floor 2, separated in the X direction thereof, and wires 30 extend from the pulleys 22*b* so as to be secured at ends corresponding to opposite side surfaces of the isolation floor 4*b* through means of lower and inner portions of the isolation floor 4*b*, respectively. Wires 35 are disposed around pulleys 24*b* coaxially mounted upon the pulleys 22*b* and are connected to the springs 12. According to structure described above, the isolation floor system movable in both the X- and Y-directions can be arranged without requiring a relatively large space for the provision of the damper means. Furthermore, it is possible to make the displacements of the springs 12 smaller than the displacements of the isolation floors 4*a* and 4*b*, thus rendering the springs 12 compact. In the case where the isolation floor system is moved in the Y-direction, the amount $\delta$ can be rendered small in comparison with the length L of the wire extending in the X-direction, so that the vibration in the Y-direction does not affect the damping function in the X direction. In a modification, the isolation floors 4*a* and 4*b* may be composed of one integral isolation floor which is constructed so as to be movable by utilizing bearing means, and the wires 30 are extensible in both the X- and Y-directions, whereby the height of the isolation floor system as measured from the bottom of the supporting floor 2 can be rendered small.

Figure 8:
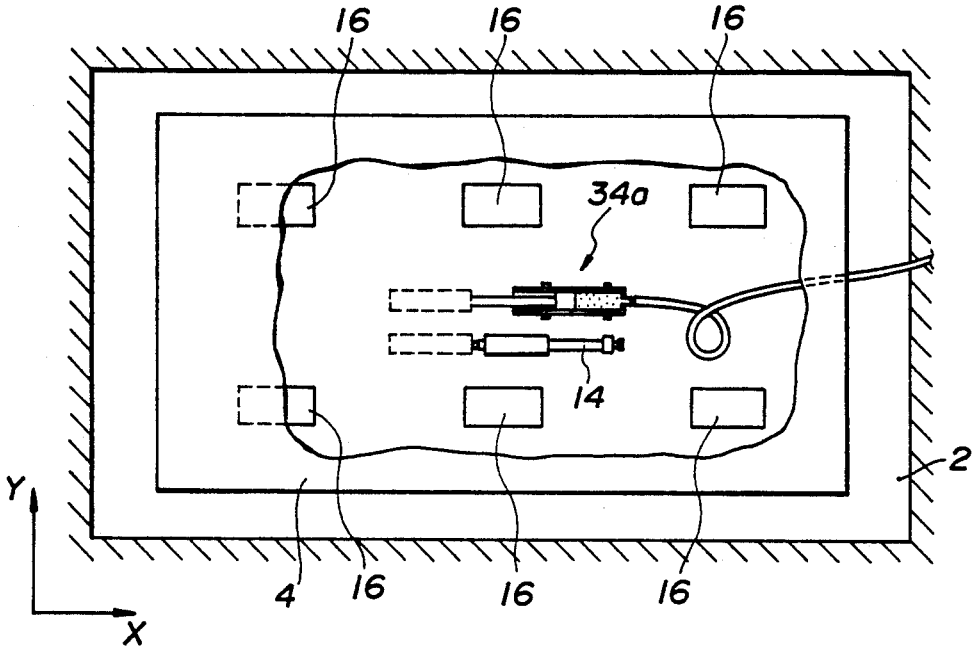
FIGS. 8 and 9 are plan and sectional views, respectively, representing a still further embodiment according to this invention.
Figure 9:
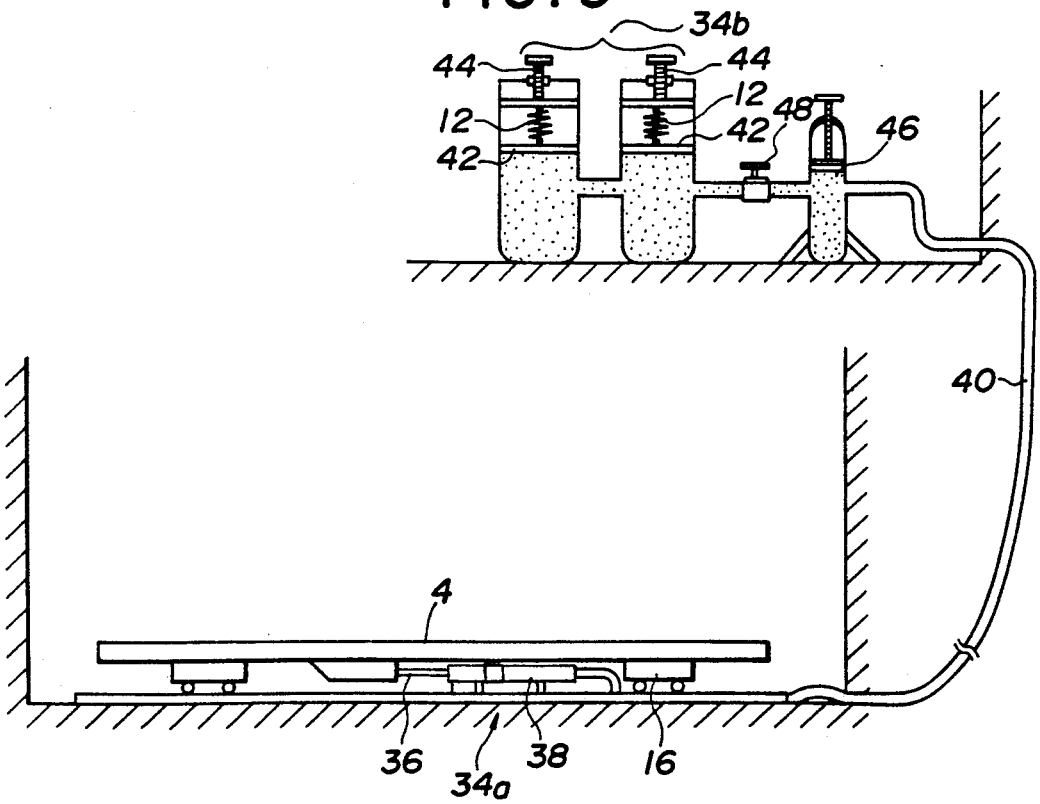

FIGS. 8 and 9 represent a further embodiment constructed according to this invention which utilizes a hydraulic means for dampers, and in which an isolation floor 4 is disposed so as to be movable in the horizontal direction by means of bearings 16. A hydraulic piston-cylinder assembly 34*a* is mounted upon a lower surface of the isolation floor 4 and the hydraulic assembly 34*a* includes a piston 36 connected to the isolation floor 4 and a cylinder 38 attached to the supporting floor 2. Another hydraulic piston-cylinder assembly, not shown, is also disposed in a direction normal to the first mentioned hydraulic piston-cylinder assembly 34*a*. The cylinder 38 is connected through means of a hose 40 to a hydraulic piston-cylinder assembly 34*b* located externally of the isolation floor system and the hydraulic assembly 34*b* includes a piston 42 biased by means of a spring 12 which is adjusted by screw means 44. In the illustrated embodiment, two hydraulic piston-cylinder assemblies 34*b* are provided. The hydraulic assembly 34*b* is further provided with an adjusting means 46 and a valve means 48. According to the structure of this embodiment, the displacement of the isolation floor 4 is transferred to the hydraulic piston-cylinder assembly 34*b* through means of hydraulic pressure so as to thereby operate the pistons 42. Each piston 42 is biased by means of the spring 12, so that the displacement of the isolation floor 4 can be damped by adjusting the spring force, changing the number of pistons 42, and changing the diameters of the respective pistons or cylinders. The fixation of the isolation floor 4 with respect to the supporting floor 2 can be easily achieved by closing the valve 48.

Figure 10:
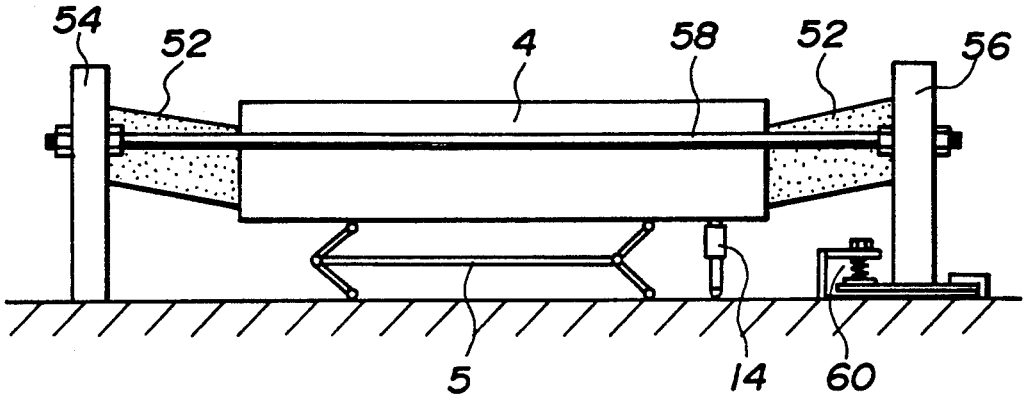
FIG. 10 is a side view of a still further embodiment according to this invention.

FIG. 10 represents a further embodiment constructed according to this invention, in which a laminated rubber member is utilized as a damper means. Referring to FIG. 10, the laminated rubber member 52 is composed of alternatingly laminated rubber plates and metallic plates, which are hardly compressed in the axial direction, whereas the same are provided with a predetermined shearing resistance with respect to a horizontal force. The shearing resistance of the laminated rubber member 52 has a tendency to be decreased when the axial compression force is increased. The laminated rubber members 52 are secured to both lateral end portions of the isolation floor 4 so as to support the entire structure between a stationary wall 54 and a movable wall 56 as shown in FIG. 10. The stationary wall 54 and the movable wall 56 are connected together by means of bolts 58 such that the width dimension defined between the walls 54 and 56 is adjustable. The isolation floor 4 and the supporting floor 2 are operatively connected together by means of a link mechanism 5 and a hydraulic damper means 14 both disposed below the isolation floor 4. According to this structure, the desired shearing resistance can be caused within the laminated rubber members 52 by adjusting the clamping force of the bolts 58, so that the isolation floor 4 can be supported under damped conditions in the vertical direction. The movable wall 56 is secured to the supporting floor 2 so as to be movable with respect thereto by means of a slide mechanism 60.

Figure 11:
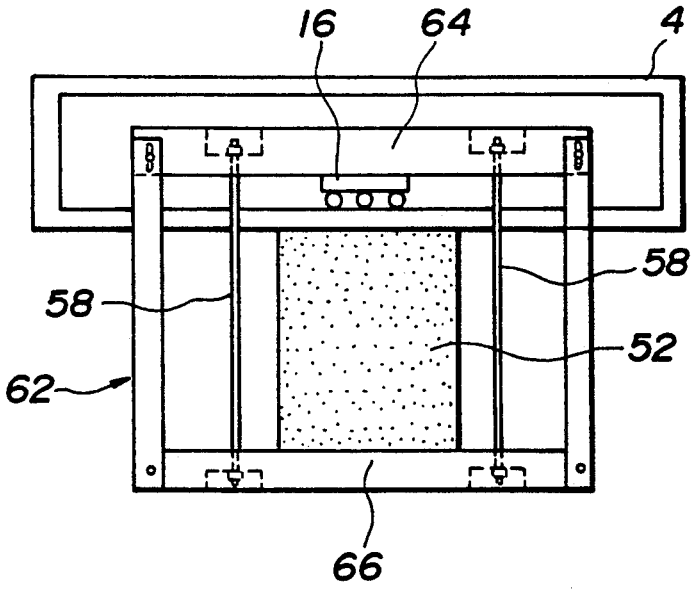
FIGS. 11, 12 and 13 are side views of modified embodiments of the embodiment shown in FIG. 10.
Figure 12:
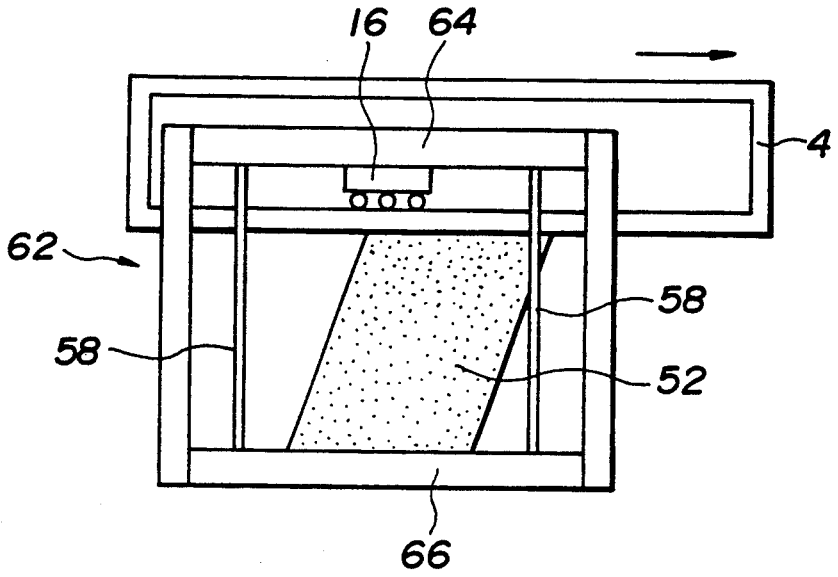

FIG. 11 represents a modification of the embodiment shown in FIG. 10, in which the lower portion of the laminated rubber member 52 is secured to a lower plate 66 of a frame 62 and the upper portion of the laminated rubber member 52 is secured to the isolation floor 4. The frame 62 includes an upper plate 64 which engages a lower surface of the isolation floor 4 through a bearing means 16. The distance defined between the upper and lower plates of the frame can be adjusted by locating bolts 58 therebetween. Accordingly, the desired shearing resistance can be provided for the laminated rubber member 52 by adjusting the clamping force of the bolts 58 and, hence, the desired embodiment of the isolation floor 4 can be realized. FIG. 12 shows the state of the isolation floor system shown in FIG. 11 in which the isolation floor 4 is displaced.

Figure 13:
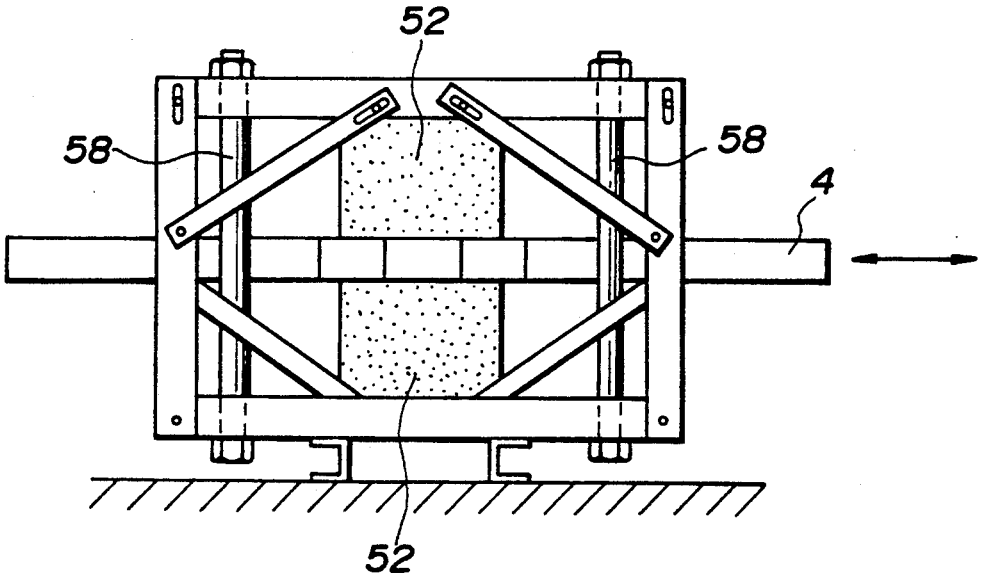

FIG. 13 further shows a modification of the embodiment shown in FIG. 11, in which the laminated rubber members 52 are disposed upon the upper and lower surfaces of the isolation floor 4 and the entire structure is supported by means of the frame 62 so that the entire structure is disposed within the frame 62. The frame 62 is clamped by means of the bolts 58 so that the distance defined between the upper and lower laminated rubber members 52 can be adjusted by means of the bolts 58. According to this structure, a suitable axial force is imparted to the laminated rubber members 52 by means of the bolts 58 so as to thereby impart a suitable elasticity to the isolation floor 4. The laminated rubber members 52 may also be disposed in an inclined manner in a substantially vertical, that is, perpendicular or horizontal direction at desired angles.

In the described embodiments, the recess formed within the existing building or structure is utilized as a supporting floor 2, but any other means or structure may be included in the isolation floor system so as to be utilized as the supporting floor, and in such an isolation floor system, there is no requirement to alter the design of the existing structure.

In the foregoing embodiments, the springs 12 or hydraulic dampers 14 are utilized as a damper, but many other devices or mechanisms may be utilized as the dampers. In addition, the length ratio of the levers or the diameter ratio of the pulleys may be increased toward the side of the damper so as to thereby increase the movement of the isolation floor 4 toward the side of the damper. In this modification, soft spring means, which have not been utilized in conventional isolation systems, can be effectively utilized. Furthermore, when the vertically movable isolation floor is to be supported, weighing means for bearing the load of the isolation floor 4 may be attached to, for example, a portion near the spring 12 of the lever 6 in FIG. 1 or to the downwardly extending wire. According to this modification, the initial load to be applied to the damper can be effectively reduced and the initial load can be further reduced by applying the balance of the load to the isolation floor 4. The isolation floor 4 may be supported by means of friction members other than bearing means 16.

It is to be noted that this invention is described hereinbefore with reference to the preferred embodiments, but this invention is not limited to the described embodiments and many other modifications and changes may be made. For example, in a further preferred embodiment, a horizontal bidirectional isolation floor system and a three dimensional isolation floor system may be realized by the combination of the vertically movable or horizontally movable isolation floor systems described hereinbefore. It is therefore to be understood that within the scope of the appended claims, the present invention may be practiced otherwise than as specifically described herein.

What is claimed is:

1. An isolation floor system for an earthquake comprising:

an supporting floor;

an isolation floor supported by said supporting floor to be movable in at least one of vertical and horizontal directions;

a damping means disposed along a moving direction of said isolation floor so as to connect said supporting floor and said isolation floor; and means connected in series to said damping means for adjusting a relative displacement between said supporting floor and said isolation floor.

2. An isolation floor system according to claim 1, wherein said displacement adjusting means comprises a pulley mechanism including one pulley and another pulley coaxially mounted to the first mentioned pulley and having a diameter different from that of the first mentioned pulley, said one pulley being connected to said isolation floor and the other pulley being connected to said damping means so as to adjust the relative displacement between said isolation floor and said supporting floor to be increased or decreased.

3. An isolation floor system according to claim 1, wherein a hydraulic piston-cylinder mechanism is further disposed between said supporting floor and said isolation floor, said hydraulic piston-cylinder mechanism being operatively connected to a hydraulic means provided with a piston having an acting surface area different from that of a piston of said hydraulic piston-cylinder mechanism and an elastic means is provided for the piston of said hydraulic means so as to extend in a direction of a displacement of the piston of said hydraulic means.

4. An isolation floor system according to claim 3, wherein said elastic means is endowed with a variable elastic resistance.

5. An isolation floor system according to claim 3, wherein said hydraulic means comprises a plurality of piston-cylinder assemblies.

6. An isolation floor system according to claim 3, wherein valve means is disposed between said hydraulic means and said hydraulic piston-cylinder mechanism disposed upon said isolation floor.

7. An isolation floor system according to claim 3, wherein said hydraulic means comprises a plurality of piston-cylinder assemblies and valve means is disposed between each of said piston-cylinder assemblies and said piston-cylinder mechanism of said isolation floor.

8. An isolation floor system according to claim 1, wherein said displacement adjusting means comprises a lever provided with a fulcrum for a pivotable operation and the relative displacement between said supporting floor and said isolation floor is adjusted to be increased or decreased by setting to predetermined values a distance between the fulcrum and the isolation floor and a distance between the fulcrum and the damping means.

9. An isolation floor system according to claim 8, wherein said lever is provided with end portions to which spring means are connected.

10. An isolation floor system according to claim 9, wherein said spring means are endowed with tension force.

11. An isolation floor system for an earthquake comprising:

a supporting floor;

an isolation floor disposed on said supporting floor to be movable in at least one of horizontal and vertical directions;

means provided with a shearing resistance which is variable in response to an axial pressure; and a damping means disposed to said means and having a pressing means operative in an axial direction thereof.

12. An isolation floor system according to claim 11, wherein said means provided with shearing resistance comprises a rubber and metallic plates laminated alternatingly.

13. An isolation floor system according to claim 11, wherein said means provided with shearing resistance having the variable shearing resistance are secured to both ends of said isolation floor with the axis of said means being horizontal and said means are clamped by said pressing means so that the axial pressure is changeable.

14. An isolation floor system according to claim 13, wherein said means provided with shearing resistance comprises rubber and a metallic plates laminated alternatingly.

15. An isolation floor system according to claim 11, wherein said means having variable shearing resistance is provided with an end portion connected to one end said pressing means, the other end of said means is secured to said isolation floor, the other end of said pressing means abuts against said isolation floor through a sliding member, and both ends of said pressing means are combined by a coupling means, thus constituting the damping means.

16. An isolation floor system according to claim 15, wherein said means provided with shearing resistance comprises a rubber and metallic plates laminated alternatingly.

17. An isolation floor system according to claim 11, wherein said isolation floor is provided with side surfaces to which said means having variable shearing resistance are secured and said pressing means is disposed so as to snap said means, thus constituting said damping means.

18. An isolation floor system according to claim 17, wherein said means provided with shearing resistance comprises a rubber and a metallic plate laminated alternatingly.

19. An isolation floor system for use in withstanding the effects of an earthquake, comprising:

a supporting floor;

an isolation floor supported by said supporting floor so as to be movable in either one of vertical and horizontal directions with respect to said supporting floor;

lever means having one end thereof connected to said isolation floor such that said one end of said lever means moves in one of said vertical and horizontal directions along with movement of said isolation floor in said one of said vertical and horizontal directions;

means fixed upon said supporting floor for pivotably supporting an intermediate portion of said lever means; and spring means mounted upon said supporting floor and connected to the other end of said lever means such that said other end of said lever means moves in the other one of said vertical and horizontal directions in response to said movement of said isolation floor in said one of said vertical and horizontal directions.

20. An isolation floor system as set forth in claim 19, wherein:

said spring means extend upon opposite sides of said other end of said lever means so as to bias said other end of said lever means in opposite directions.

21. An isolation floor system according to claim 17, wherein wire means is connected at one end to said isolation floor and the other end of said wire means is connected to damping means arranged in a direction different from the moving direction of said isolation floor.

22. An isolation floor system according to claim 21, wherein said isolation floor is arranged to be movable in a horizontal direction, multiple laminated pulley means is secured to said supporting floor with the axis being horizontally directed, and said isolation floor and said damping means are connected through said pulley means.

23. An isolation floor system according to claim 17, wherein said isolation floor is arranged to be movable in a vertical direction, said isolation floor being operatively connected to said spring means horizontally arranged upon said supporting floor.

24. An isolation floor system according to claim 23, wherein said supporting floor is constructed such that said isolation floor is movable in a horizontal direction.

25. An isolation floor system as set forth in claim 19, wherein:

said lever means has a substantially L-shaped configuration comprising a first long leg, having a predetermined length and interconnecting said isolation floor and said means pivotably supporting said intermediate portion of said lever means, and a second short leg, having a predetermined length and interconnecting said spring means and said means pivotably supporting said intermediate portion of said lever means, said first and second legs of said lever means intersecting each other at a fulcrum defined at said intermediate portion of said lever means pivotably supported upon said means fixed upon said supporting floor such that depending upon said predetermined lengths of said first and second legs of said lever means, the relative displacement between said isolation floor and said supporting floor can be predetermined.

26. An isolation floor system as set forth in claim 25, wherein:

said first long leg extends substantially horizontally between said fulcrum and said isolation floor, and said second short leg extends substantially vertically between said fulcrum and said spring means.

27. An isolation floor system as set forth in claim 25, wherein:

said long and short legs of said lever means have a predetermined angle defined therebetween.

28. An isolation floor system for use in withstanding the effects of an earthquake, comprising:

a supporting floor;

an isolation floor supported upon said supporting floor so as to be movable in either one of vertical and horizontal directions;

spring means mounted upon said supporting floor; and lever means, pivotably mounted upon said supporting floor and having one end thereof connected to said isolation floor so as to be movable along with said isolation floor in one of said vertical and horizontal directions, and another end thereof connected to said spring means, for changing the direction of movement of said one end of said lever means as said isolation floor moves in said one of said vertical and horizontal directions such that said another end of said pivotably mounted lever means moves in the other one of said vertical and horizontal directions and is controlled by said spring means.

29. An isolation floor system according to claim 28, wherein said changing means comprises multiple laminated pulley means including one pulley and another pulley coaxially mounted to said first mentioned pulley and having a diameter different from that of the first mentioned pulley, said one pulley being connected to said isolation floor and said other pulley being connected to a damping means so as to increase or decrease the relative displacement between said supporting floor and said isolation floor.

30. An isolation floor system as set forth in claim 28, wherein:

said isolation floor is supported upon said supporting floor so as to be movable in said vertical direction, and said spring means extends horizontally.

31. An isolation floor system as set forth in claim 28, wherein:

said supporting floor is constructed such that said isolation floor is movable in said horizontal direction.

32. An isolation floor system as set forth in claim 28, wherein:

said spring means extend upon opposite sides of said another end of said lever means so as to bias said another end of said lever means in opposite directions.

33. An isolation floor system as set forth in claim 28, wherein:

said lever means has a substantially L-shaped configuration comprising a first long leg, having a predetermined length and interconnecting said isolation floor to said supporting floor at a location at which said lever means is pivotably supported upon said supporting floor, and a second short leg, having a predetermined length and interconnecting said location and said spring means, said first and second legs of said lever means intersecting each other at a fulcrum defined at said location such that depending upon said predetermined lengths of said first and second legs of said lever means, the relative displacement between said isolation floor and said supporting floor can be predetermined.

34. An isolation floor system as set forth in claim 33, wherein:

said first long leg extends substantially horizontally between said fulcrum and said isolation floor, and said second short leg extends substantially vertically between said fulcrum and said spring means.

35. An isolation floor system as set forth in claim 33, wherein:

said long and short legs of said lever means have a predetermined angle defined therebetween.

36. An isolation floor system according to claim 29, wherein a wire means is connected at one end to said isolation floor and the other end of said wire means is connected to a damping means arranged in a direction different from the moving direction of said isolation floor.

37. An isolation floor system according to claim 36, wherein said isolation floor is arranged to be movable in a horizontal direction and multiple laminated pulley means is secured to said supporting floor with the axis being horizontally directed and said isolation floor is connected to said damping means through said pulley means.

38. An isolation floor system according to claim 28, wherein said isolation floor is arranged to be movable in a vertical direction and said isolation floor is connected to a damping means disposed in said supporting floor through a wire means.

39. An isolation floor system according to claim 38, wherein said isolation floor is constructed as an isolation floor also movable in a horizontal direction.

40. An isolation floor system according to claim 28, wherein a hydraulic piston-cylinder mechanism is further disposed between said supporting floor and said isolation floor, said hydraulic piston-cylinder mechanism being operatively connected to hydraulic means provided with a piston having an acting surface area different from that of a piston of said hydraulic piston-cylinder mechanism and an elastic means is provided for the piston of said hydraulic means so as to extend in an acting direction of said piston of said hydraulic means.

41. An isolation floor system according to claim 40, wherein said elastic means is endowed with a variable elastic resistance.

42. An isolation floor system according to claim 40, wherein said hydraulic means comprises a plurality of piston-cylinder assemblies.

43. An isolation floor system according to claim 40, wherein a valve means is disposed between said hydraulic means and said hydraulic piston-cylinder mechanism of said isolation floor.

44. An isolation floor system according to claim 40, wherein said hydraulic means comprises a plurality of piston-cylinder assemblies and a valve means is disposed between each of said piston-cylinder assemblies and said piston-cylinder mechanism of said isolation floor.

* * * * *